US010046218B2

(12) United States Patent
Planakis

(10) Patent No.: US 10,046,218 B2
(45) Date of Patent: Aug. 14, 2018

(54) NON-PLANAR TABLE TENNIS RACKET

(71) Applicant: Leo Nicholas Planakis, Alpharetta, GA (US)

(72) Inventor: Leo Nicholas Planakis, Alpharetta, GA (US)

( * ) Notice: Subject to any disclaimer, the term of this patent is extended or adjusted under 35 U.S.C. 154(b) by 0 days.

(21) Appl. No.: 15/644,525

(22) Filed: Jul. 7, 2017

(65) Prior Publication Data

US 2018/0015341 A1 Jan. 18, 2018

Related U.S. Application Data

(60) Provisional application No. 62/493,703, filed on Jul. 14, 2016.

(51) Int. Cl.
*A63B 60/34* (2015.01)
*A63B 59/42* (2015.01)
*A63B 102/16* (2015.01)

(52) U.S. Cl.
CPC ..... *A63B 60/34* (2015.10); *A63B 59/42* (2015.10); *A63B 2102/16* (2015.10)

(58) Field of Classification Search
CPC ..... A63B 60/34; A63B 59/40; A63B 59/42; A63B 59/45; A63B 2102/16
See application file for complete search history.

(56) References Cited

U.S. PATENT DOCUMENTS 2,147,110 A * 2/1939 Schmid ..... A63B 59/40 473/526
4,155,550 A * 5/1979 Planakis ..... A63B 49/08 473/526
4,293,129 A * 10/1981 Planakis ..... A63B 49/02 473/533
5,139,258 A * 8/1992 McPoyle ..... A63B 67/04 473/528
5,312,101 A * 5/1994 McDaniel ..... A63B 59/40 473/526
8,858,372 B1 * 10/2014 Trieu ..... A63B 59/04 473/527
2003/0013564 A1 * 1/2003 McDaniel ..... A63B 59/40 473/527
2005/0181895 A1 * 8/2005 Popovich ..... A63B 59/40 473/527
2006/0084533 A1 * 4/2006 Siow ..... A63B 59/40 473/524
2010/0317468 A1 * 12/2010 Tang ..... A63B 49/08 473/549

(Continued)

OTHER PUBLICATIONS

Robbins, Dan, Quick Reference Rules of Table Tennis, Table Tennis Rules (Ping Pong) and Regulations for Paddles, http://www.robbinstabletennis.com/rurack.htm.

(Continued)

*Primary Examiner* — Raleigh W Chiu

(74) *Attorney, Agent, or Firm* — Brient IP Law, LLC; Michael J. Baldauff, Jr.

(57) ABSTRACT

A non-planar table tennis racket includes a racket blade and a racket handle connected together according to an offset angle. The linear configuration of the handle connected directly to the planar racket blade creates a non-planar racket body that is asymmetrical and unbalanced, capable of imparting ultrahigh spin to a table tennis ball.

19 Claims, 6 Drawing Sheets

(56) References Cited

U.S. PATENT DOCUMENTS

| | | | | |
|---|---|---|---|---|
| 2014/0302953 | A1* | 10/2014 | Kettler | B29C 45/16 473/527 |
| 2015/0224377 | A1* | 8/2015 | Kowalke | A63B 59/04 473/527 |

OTHER PUBLICATIONS

Letts, Greg, Spin in Table Tennis/Ping-Pong, Spin in Table Tennis/Ping-pong-What It Is and How It Works, http://tabletennis.about.com/od/spin/a/spin.htm.

* cited by examiner

NON-PLANAR TABLE TENNIS RACKET

CLAIM OF PRIORITY

This application claims priority to U.S. Provisional Patent Application No. 62/493,703, filed Jul. 14, 2016, entitled "A Table Tennis Racket Which Imparts Ultra High Spin".

TECHNICAL FIELD

This disclosure relates to table tennis equipment, and specifically to a non-planar table tennis racket configured to impart ultrahigh spin on a ball.

BACKGROUND

Table tennis is a sport that when played competitively, relies on the use of ball spin to enable players to hit with a very fast pace while ensuring that the ball will bounce off the surface of the table on the opponent's end. When a player hits the ball with topspin, aerodynamic forces create a downward force on the ball, causing the ball to drop towards the table. The greater the spin, the greater the downward force imposed on the ball. As a result, a player who creates a greater amount of topspin can hit the ball with more force as compared to a player who creates less topspin because the greater topspin will create greater downward force on the ball, thereby reducing the chance that the ball will travel beyond the end of the table.

Traditional table tennis rackets are naturally balanced because the mass of the racket is symmetrically distributed around a longitudinal axis extending through the handle and the racket blade. By utilizing rackets that are symmetrical and balanced, players can easily control the racket and corresponding racket stroke, while utilizing either side of the racket blade to strike the ball during forehand and backhand strokes. However, the uniformly symmetrical, balanced design of conventional table tennis rackets places an artificial ceiling on the amount of spin that a player can generate on the ball because of the limitations of the common racket design.

It is with respect to these considerations and others that the disclosure made herein is presented.

SUMMARY

It should be appreciated that this Summary is provided to introduce a selection of concepts in a simplified form that are further described below in the Detailed Description. This Summary is not intended to be used to limit the scope of the claimed subject matter.

Concepts and technologies described herein provide for a non-planar table tennis racket. According to one aspect, a non-planar table tennis racket includes a racket blade and a racket handle. The racket blade is positioned in a blade plane and has two opposing faces for striking a table tennis ball. The racket handle has a linear configuration with a longitudinal axis extending from a base end to a blade connection end of the racket handle. The blade connection end of the racket handle is connected to the racket blade in a non-planar configuration so that the longitudinal axis is offset from the blade plane according to an offset angle.

According to yet another aspect, a non-planar table tennis racket has an asymmetrical racket body. The asymmetrical racket body includes a racket blade and a racket handle. The racket blade has two opposing faces positioned in a blade plane. The racket handle has a linear configuration with a longitudinal axis extending from a base end of the racket handle to a blade connection end of the racket handle. The racket handle is connected to the racket blade in a non-planar configuration with the longitudinal axis positioned at an offset angle to the blade plane.

According to another aspect, a non-planar table tennis racket includes a racket handle connected to a racket blade at an offset angle. The center of gravity of the non-planar table tennis racket is offset from a longitudinal axis, creating a racket body that is unbalanced and asymmetrical.

The features, functions, and advantages that have been discussed can be achieved independently in various embodiments of the present disclosure or may be combined in yet other embodiments, further details of which can be seen with reference to the following description and drawings.

DETAILED DESCRIPTION

Figure 1:
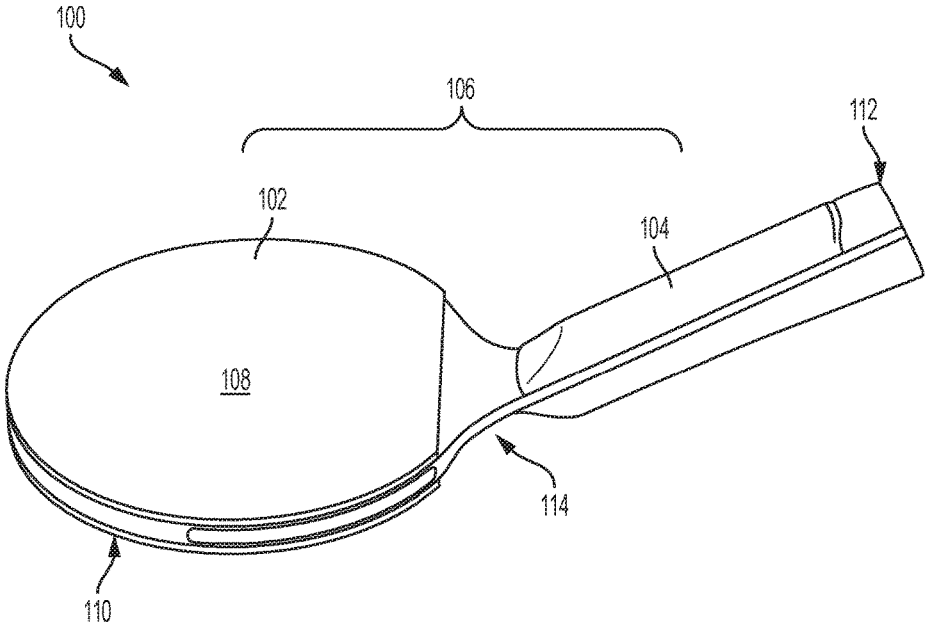
FIG. 1 is a top perspective view of a non-planar table tennis racket according to various embodiments described herein.
Figure 2:
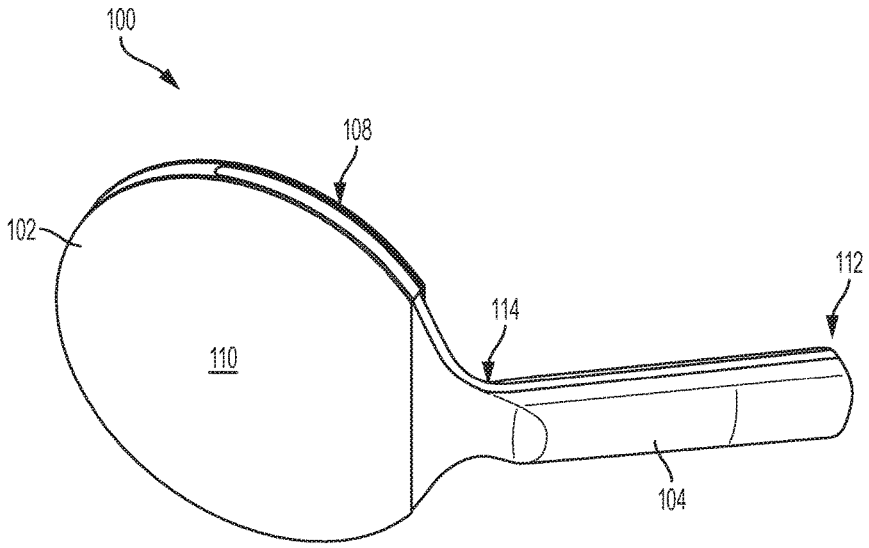
FIG. 2 is a bottom perspective view of a non-planar table tennis racket according to various embodiments described herein.

The following detailed description is directed to a non-planar table tennis racket that is capable of imparting ultrahigh spin to a table tennis ball. For the purposes of this discussion, "ultrahigh" may be understood as including spin greater than 150 revolutions per second. Table tennis balls typically spin at less than 150 revolutions per second during competitive play using traditional planar or symmetrical table tennis rackets. Because the rotational velocity depends not only on the equipment being used, but also on the technique and skill of the player, the 150 revolutions per second value used herein should not be considered limiting. Rather, the non-planar table tennis racket of the various embodiments described herein should be understood to be capable of providing significantly more ball rotation than conventional table tennis rackets because of the angled, non-planar design shown and described with respect to FIGS. 1-6.

As discussed above, a conventional table tennis racket is symmetrical around a longitudinal axis extending through the handle and center of the racket blade. The resulting racket is balanced and easy to control, allowing the player to use the front and rear surfaces of the racket head (or "blade") to strike the ball during forehand and backhand strokes. However, the amount of spin that is placed on the table tennis ball with a traditional balanced and symmetrical racket isn't optimal since the center of the racket blade (the "sweet spot" for ball contact) is positioned on the longitudinal axis extending through the handle. Rotation of the racket blade around the longitudinal axis, by itself, imparts very little spin to the ball if the ball is contacted in the center of the blade. The conventional racket requires the player to generate spin using the angle of the blade with respect to the table when the ball is struck, the upward or downward motion (coupled with the forward motion) of the racket when the ball is struck, and the force at which the ball is struck.

However, utilizing the concepts and technologies described herein, a non-planar table tennis racket is provided to increase the spin imparted on a table tennis ball. Table tennis rules are very liberal with respect to the table tennis racket. The rules state explicitly that a racket may be of any size, shape, or weight. The various embodiments discussed herein provide a non-planar table tennis racket that is unbalanced and asymmetrical, which is a substantial departure from the configuration of a conventional planar table tennis racket. The benefits of this non-planar configuration are significant and will become clear in the discussion below.

In the following detailed description, references are made to the accompanying drawings that form a part hereof, and which are shown by way of illustration, specific embodiments, or examples. Referring now to the drawings, in which like numerals represent like elements through the several figures, a non-planar table tennis racket according to the various embodiments will be described.

FIGS. 1-5 show top perspective, bottom perspective, side, top, and front views, accordingly, of a non-planar table tennis racket 100 according to various embodiments described herein. Looking at these figures together, the table tennis racket 100 includes a racket blade 102 connected to a racket handle 104, which together form the racket body 106. The racket handle 104 includes a base end 112 and a blade connection end 114. The blade connection end 114 connects the racket handle 104 to the racket blade 102. The racket blade 102 includes a first face 108 (FIGS. 1 and 4) and a second face 110 (FIGS. 2 and 5) opposite the first face. The first face 108 and the second face 110 are both configured to strike a table tennis ball, which includes being exposed and being made from, or covered with, any suitable material conventionally used for table tennis rackets. The second face 110 may be covered with a second material having a second color (i.e., red) that distinguishes the second face 110 from a first material of a first color (i.e., black) of the first face 108.

According to various embodiments, due to the angled configuration of the non-planar table tennis racket 100, a player would utilize the second face 110 to strike a table tennis ball almost exclusively, meaning during a majority of both forehand and backhand strokes. Because of the non-planar configuration, transitioning between forehand and backhand strokes includes the player rotating the wrist and hand holding the racket handle 104 without having to adjust the player's grip on the handle. As a result, the transition time between a forehand and backhand stroke is significantly shortened as compared to traditional table tennis rackets.

Figure 3:
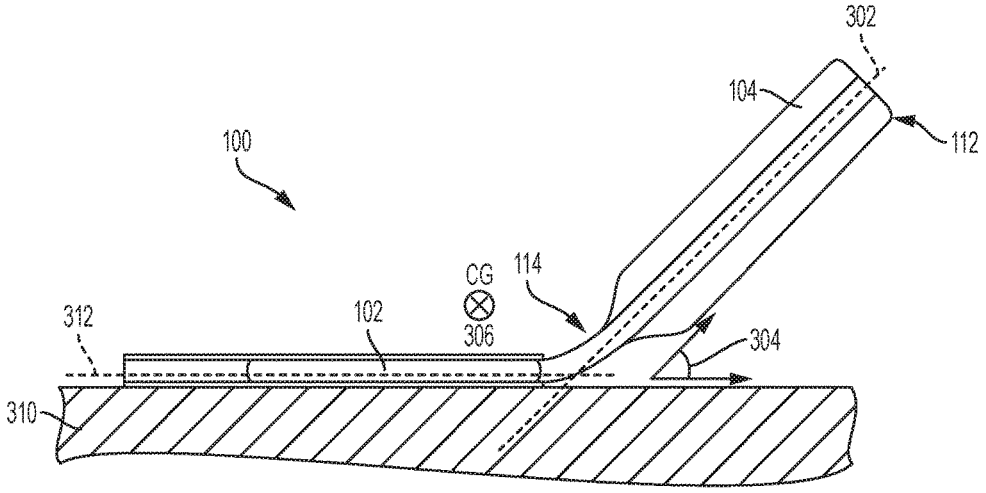
FIG. 3 is a side view of a non-planar table tennis racket on a surface to illustrate an offset angle according to various embodiments described herein.
Figure 4:
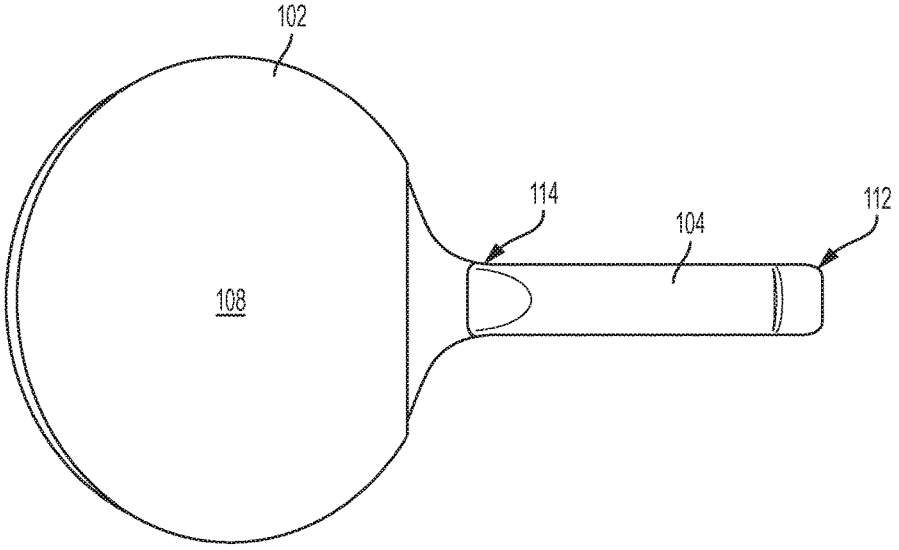
FIG. 4 is a top view of a non-planar table tennis racket according to various embodiments described herein.
Figure 5:
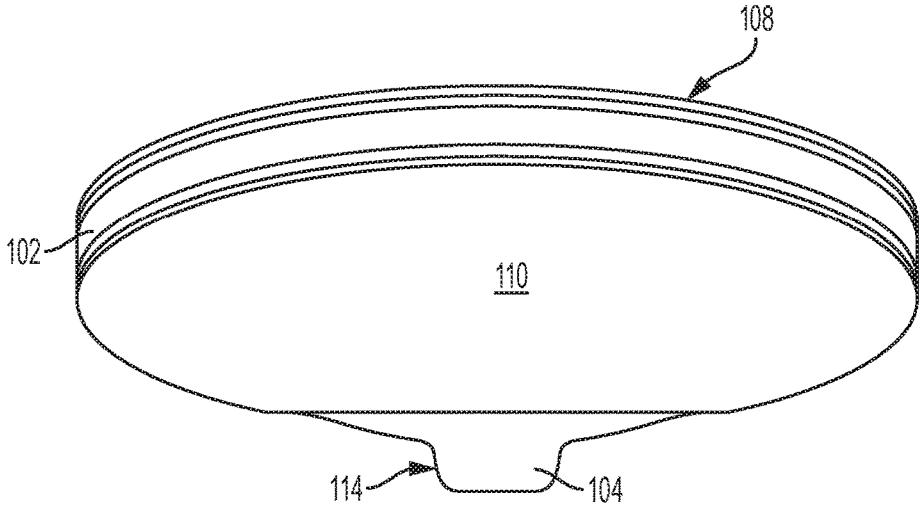
FIG. 5 is a front view of a non-planar table tennis racket according to various embodiments described herein.

Looking at FIG. 3, further details regarding the unbalanced, asymmetrical configuration of the non-planar table tennis racket 100 will be discussed. FIG. 3 shows a side view of the non-planar table tennis racket 100 as the racket blade 102 is resting on a surface 310. The longitudinal axis 302 of the handle 104 is shown extending centrally through the racket handle 104. Similarly, the racket blade 104 is positioned within a blade plane 312. The longitudinal axis 302 of the handle 104 is disposed at an offset angle 304 to the blade plane 312 to create the non-planar configuration. In various embodiments, the offset angle 304 may be between 10-45 degrees. In preferred embodiments, the offset angle 304 may be between 15-40 degrees. In some preferred embodiments, the offset angle 304 may be between 15-35 degrees. In other preferred embodiments, the offset angle may be between 20-35 degrees for optimizing the spin imparted on a table tennis ball. According to one illustrative embodiment, the offset angle 304 is approximately 30 degrees. In a second illustrative example, the offset angle is approximately 25 degrees. It should be understood by those of skill in the table tennis arts that an offset angle of between 25-30 degrees places the racket blade at the optimal ready position for most players.

Because the mass of the racket handle 104 is centered on the longitudinal axis 302 of the handle 104 and the mass of the racket blade 102 is centered on the blade plane 312, the center of gravity 306 is located offset from both the longitudinal axis 302 of the handle and the blade plane 312. The positioning of the center of gravity 306 shown in FIG. 3 is not limited to the precise position shown. Rather, the center of gravity 306 is marked in FIG. 3 to illustrate that the center of gravity 306 is not collinear with the longitudinal axis 302, as is the situation with conventional balanced table tennis rackets. Because the center of gravity 306 is not collinear with the longitudinal axis 302, the non-planar table tennis racket 100 is considered unbalanced.

All conventional planar table tennis rackets are naturally balanced because the mass of the racket is symmetrically distributed around the longitudinal axis of the racket. In contrast, the non-planar table tennis racket 100 described according to the various embodiments herein is naturally unbalanced because of the asymmetrical distribution of the mass of the racket. With typical racket sports, an unbalanced racket is undesirable because of the difficulty in controlling the racket head due to the moment or torque induced by the center of gravity being offset from the axis through the racket handle. However, the unbalanced nature of the non-planar table tennis racket 100 is not detrimental in the table tennis context since the weight and amount of unbalance is within acceptable limits for providing accurate control for most table tennis players. Rather, because the non-planar table tennis racket 100 is unbalanced, it is lighter than balanced angle rackets in the prior art. Additionally, the non-planar, unbalanced table tennis racket 100 also allows the player to utilize the same side of the racket blade for both forehand and backhand strokes by merely rotating the player's hand and wrist. This reduces the reaction time necessary to reposition the table tennis racket from a forehand to a backhand position and vis-à-vis since the player does not need to rotate the racket handle to move between the first side of the racket blade to the second side of the racket blade.

The asymmetrical, unbalanced design of the non-planar table tennis racket 100 described herein creates significantly more spin on a table tennis ball than conventional planar designs for several reasons. First, the contact location on the racket blade 102 where the second face 110 contacts the table tennis ball is offset from the longitudinal axis 302 of the handle 104 rather than aligned with the axis. Because the contact location is offset, rotation of the racket handle 104 by the player creates a radial movement and corresponding angular momentum associated with the racket blade 102 at the contact location as the racket blade 102 rotates around the longitudinal axis 302 of the handle. This angular momentum from the wrist and hand rotation of the player, coupled with the conventional arm motion during the stroke of the non-planar table tennis racket 100, imparts ultrahigh spin as the racket blade 102 contacts and repels the table tennis ball.

In addition, the offset angle 304 of the non-planar table tennis racket 100 allows a player to hit the table tennis ball in a more forward position as compared to a traditional planar table tennis racket. Doing so not only assists the player in keeping an eye on the ball during contact to better control the ball, but also allows for more forward movement of the racket prior to contact. This increased forward movement allows for an increased racket head speed at the point of contact with the table tennis ball, which translates into more spin.

Non-planar racket configurations have been utilized in the past in the context of tennis rackets. U.S. Pat. No. 4,155,550 to Planakis (hereinafter described as the '550 patent) discloses an offset tennis racket that increases spin placed on a tennis ball. The discussion in the '550 patent corresponding to the manner in which the '550 racket increases spin placed on a tennis ball applies to the manner in which the non-planar table tennis racket 100 described herein increases spin imparted to a table tennis ball. However, the configuration of the '550 tennis racket is substantially different than the configuration of the non-planar table tennis racket 100. The '550 racket is a balanced racket. The center of gravity is positioned along the axis running through the hand grip portion. As explicitly stated in the '550 patent, the center of gravity must be along the hand grip axis. To accomplish the critical placement of the center of gravity along the hand grip axis, the handle of the racket includes a downwardly curved shank portion that connects the hand grip portion to the base of the head of the racket. The shank portion is offset to one side of the hand grip axis, while the head of the racket is disposed at the opposite side of the hand grip axis to align the center of gravity of the '550 tennis racket with the hand grip axis.

In contrast to the '550 tennis racket, the non-planar table tennis racket 100 according to the various embodiments described herein has a linear racket handle 104 with a blade connection end 114 that directly connects to the racket blade 102 without any shank portion that curves to one side of the longitudinal axis 302 of the handle. The resulting center of gravity 306 positioning is offset from the longitudinal axis 302 of the handle, creating an unbalanced table tennis racket. This direct connection of the linear racket handle 104 to the racket blade 102 saves weight as compared to the '505 tennis racket and shortens the required length of the racket handle 104.

U.S. Pat. No. 4,293,129 to Planakis (hereinafter described as the '129 patent) also discloses a tennis racket that increases spin placed on a tennis ball. However, the '129 racket has two nonparallel playing surfaces. The two nonparallel playing surfaces on opposing sides of the '129 racket creates a symmetrical racket configuration that is balanced. In contrast to the '129 tennis racket, the non-planar table tennis racket 100 according to the various embodiments described herein has a single racket blade 102 connected to the racket handle 104 in an asymmetrical configuration that creates an unbalanced racket.

While the spin-inducing benefits of the '129 tennis racket apply to the non-planar table tennis racket 100 described herein, the double racket heads of the '129 tennis racket and resulting symmetrical configuration are significantly different from the single offset racket blade 102 and resulting asymmetrical configuration of the non-planar table tennis racket 100. Moreover, although the first face 108 of the non-planar table tennis racket 100 is not often used during normal play, the player using the non-planar table tennis racket 100 has an option to use the first face 108, as well as the second face 110. Because the first face 108 and the second face 110 are angled toward and away from the racket handle 104 in significantly different configurations, use of the first face 108 and the second face 110 provide drastically different opportunities to vary the spin placed on the table tennis ball. In contrast, the '129 racket provides identical playing surfaces on both sides of the tennis racket.

Figure 6:
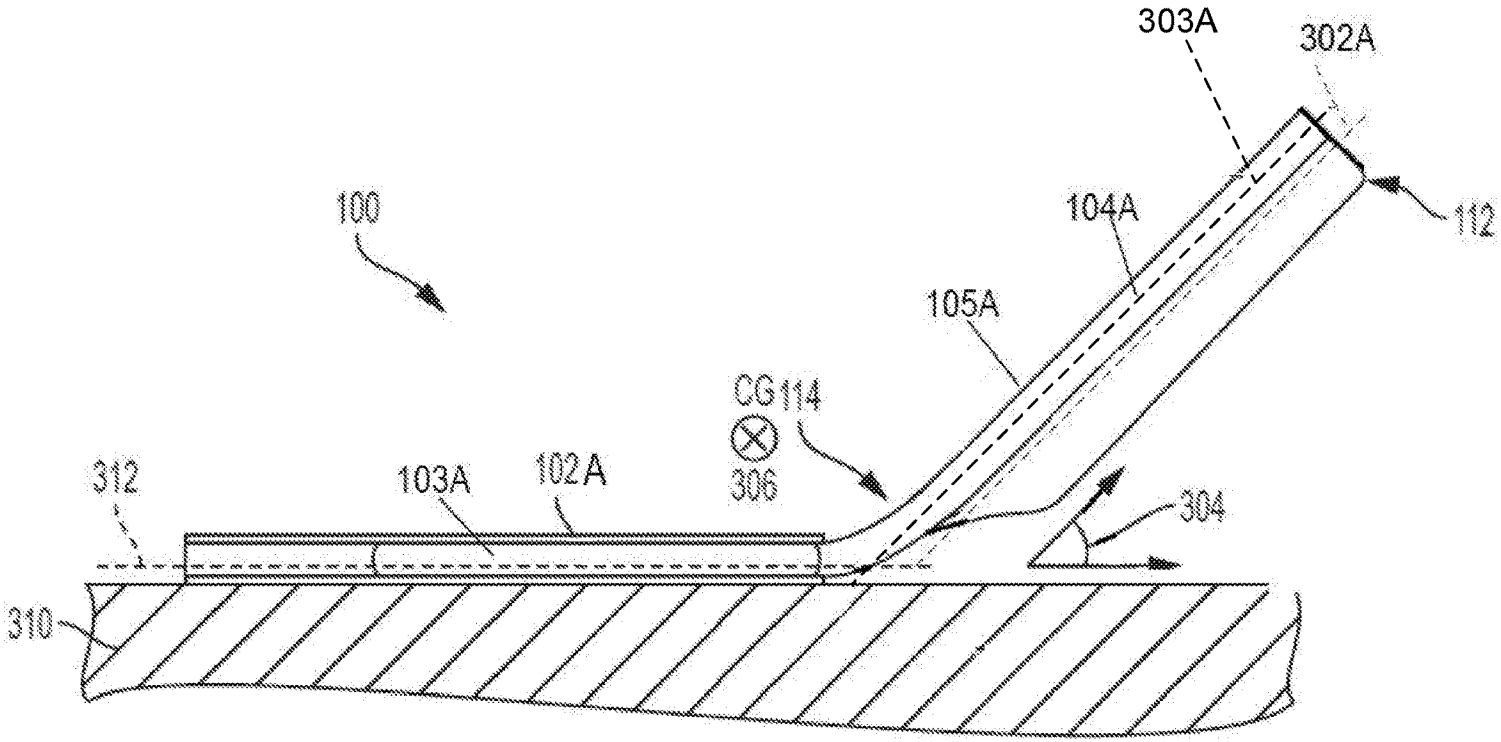
FIG. 6 is a side view of a non-planar table tennis racket on a surface to illustrate an offset angle according to an alternate embodiment described herein.

According to various alternate embodiments and referring to FIG. 6, the non-planar table tennis racket 100 may include additional spin-inducing features to further increase the amount of spin imparted on a table tennis ball. For example, a substrate 103A of the racket blade 102A can be integrally formed with the handle 104A so that the substrate 103A becomes a part of the outer surface 105A of the racket handle 104A. In this configuration, the substrate 103A of the racket blade 102A is no longer centered on the longitudinal axis 302A but, is instead, centered about a longitudinal axis 303A that is spaced apart from the longitudinal axis 302A of the handle 104A. As a result of the configuration shown in FIG. 6, radial movement of the racket blade 102A around the longitudinal axis 302A of the handle 104A is increased when the player's wrist and hand are rotated since the longitudinal axis 303A of the substrate 103A in the handle 104 is spaced apart from the longitudinal axis 302A of the handle 104A. Accordingly, an increase in the radial movement of the racket blade 102A increases the magnitude of the spin that is imparted to the table tennis ball.

Based on the foregoing, it should be appreciated that technologies for a non-planar table tennis racket are provided herein. The subject matter described above is provided by way of illustration only and should not be construed as limiting. Various modifications and changes may be made to the subject matter described herein without following the example embodiments and applications illustrated and described, and without departing from the true spirit and scope of the present disclosure, which is set forth in the following claims.

What is claimed:

1. A non-planar table tennis racket, comprising:

a racket blade positioned in a blade plane and having a first face and a second face opposite the first face, each of the first face and the second face configured to strike a ball; and a racket handle having a linear configuration with a longitudinal axis extending from a base end to a blade connection end of the racket handle, wherein the blade connection end of the racket handle is connected to the racket blade in a non-planar configuration such that the longitudinal axis of the handle is disposed at an offset angle to the blade plane, at least a portion of the blade intersects the longitudinal axis of the handle at the blade connection end, and the racket is unbalanced about the handle longitudinal axis.

2. The non-planar table tennis racket of claim 1, wherein the offset angle between the longitudinal axis and the blade plane is between 15 to 40 degrees.

3. The non-planar table tennis racket of claim 2, wherein the offset angle is 20 degrees.

4. The non-planar table tennis racket of claim 1, wherein the non-planar configuration is asymmetrical.

5. The non-planar table tennis racket of claim 1, wherein the non-planar table tennis racket comprises a center of gravity that is not collinear with the longitudinal axis.

6. The non-planar table tennis racket of claim 1, wherein the racket blade is coupled to the blade connection end of the racket handle at a point that is radially offset from the longitudinal axis of the racket handle.

7. The non-planar table tennis racket of claim 1, wherein the first face comprises a first material of a first color and the second face comprises a second material of a second color different from the first color.

8. A non-planar table tennis racket, comprising an asymmetrical racket body having:

a racket blade positioned in a blade plane and having a first face and a second face opposite the first face; and a racket handle having a linear configuration with a longitudinal axis extending from a base end to a blade connection end of the racket handle, the racket handle connected to the racket blade in a non-planar configuration such that the longitudinal axis of the handle is disposed at an offset angle to the blade plane;

wherein the non-planar table tennis racket is unbalanced, the racket blade further comprises a substrate positioned intermediate the first face and the second face, and the racket handle further comprises a portion that is formed from the racket blade substrate.

9. The non-planar table tennis racket of claim 8, wherein the offset angle between the longitudinal axis of the handle and the blade plane is between 15 to 40 degrees.

10. The non-planar table tennis racket of claim 9, wherein the offset angle is between 20-35 degrees.

11. The non-planar table tennis racket of claim 8, wherein the offset angle is between 25 degrees.

12. The non-planar table tennis racket of claim 8, wherein the non-planar table tennis racket comprises a center of gravity that is not collinear with the longitudinal axis.

13. The non-planar table tennis racket of claim 8, wherein:

the substrate in the racket handle is positioned off center of the longitudinal axis of the racket handle.

14. The non-planar table tennis racket of claim 13, wherein:

the substrate in the racket handle is centered about a second longitudinal axis; and the longitudinal axis of the handle is spaced apart from the second longitudinal axis of the substrate.

15. The non-planar table tennis racket of claim 8, wherein the first face comprises a first material of a first color and the second face comprises a second material of a second color different than the first color.

16. A non-planar table tennis racket, comprising a racket body having a racket handle connected to a racket blade at an offset angle, the racket blade having a blade plane, such that the center of gravity of the non-planar table tennis racket is offset from a longitudinal axis of the handle and such that the racket body is unbalanced and asymmetrical, wherein a portion of the racket blade is positioned to abut a blade connection end of the racket handle such that the racket blade plane intersects the longitudinal axis of the racket handle at the blade connection end of the racket handle.

17. The non-planar table tennis racket of claim 16, wherein the offset angle between the longitudinal axis of the handle and a plane of the racket blade is between 15 to 45 degrees.

18. The non-planar table tennis racket of claim 17, wherein the offset angle is between 20-30 degrees.

19. The non-planar table tennis racket of claim 16, wherein the racket blade is integrally formed with at least a portion of the racket handle.

* * * * *